US005609557A

United States Patent [19]

Te

[11] Patent Number: 5,609,557

[45] Date of Patent: Mar. 11, 1997

[54] PAPER PALLET WITH AN IMMPROVED CONFIGURATION

[76] Inventor: Tan Y. Te, No. 1-2, Lane 975, Chun-Jih Road, Tao-Yuan City, Taiwan

[21] Appl. No.: 637,300

[22] Filed: Apr. 24, 1996

Related U.S. Application Data

[63] Continuation-in-part of Ser. No. 246,188, May 19, 1994, abandoned.

[51] Int. Cl.[6] ..... B31B 1/14; B65D 19/00

[52] U.S. Cl. ..... 493/344; 493/342; 493/964; 83/86; 83/318; 108/51.3

[58] Field of Search ..... 493/342, 343, 493/344, 363, 373, 379, 393, 394, 953, 964, 965, 968; 108/51.3, 52.1; 83/509, 284, 123, 318, 86

[56] References Cited

U.S. PATENT DOCUMENTS

| | | | |
|---|---|---|---|
| 3,148,572 | 9/1964 | Lindholm | 83/145 |
| 4,092,890 | 6/1978 | Bousquet | 83/284 |
| 4,385,564 | 4/1983 | Heggenstaller | 108/51.1 |
| 4,792,325 | 12/1988 | Schmidtke | 493/964 |
| 5,083,996 | 1/1992 | Smith | 493/344 |
| 5,184,558 | 2/1993 | Wozniacki | 493/964 |
| 5,337,679 | 8/1994 | Moorman | 108/51.3 |
| 5,411,786 | 4/1995 | Kuo | 108/51.3 |
| 5,413,662 | 4/1995 | Skinner, III | 108/51.1 |
| 5,433,156 | 7/1995 | Hutchison | 108/51.3 |

*Primary Examiner*—Joseph J. Hail, III
*Assistant Examiner*—Christopher W. Day
*Attorney, Agent, or Firm*—Morton J. Rosenberg; David I. Klein

[57] ABSTRACT

A paper pallet (D, D1) formed by cutting and combining a plurality of cardboard panels (3). A cutting device (A), extruding mechanism (B), and an adhesive application mechanism (C) are generally provided to sequentially cut and adhesively accumulate layers of cardboard extrusion members (3*a*, 3*d*) into a multi-layered cardboard assembly characterized in that the stress applied the pallet (D, D1) formed therefrom is parallel to the corrugations of the cardboard panels (3) employed. A high-strength paper pallet is thus realized.

8 Claims, 8 Drawing Sheets

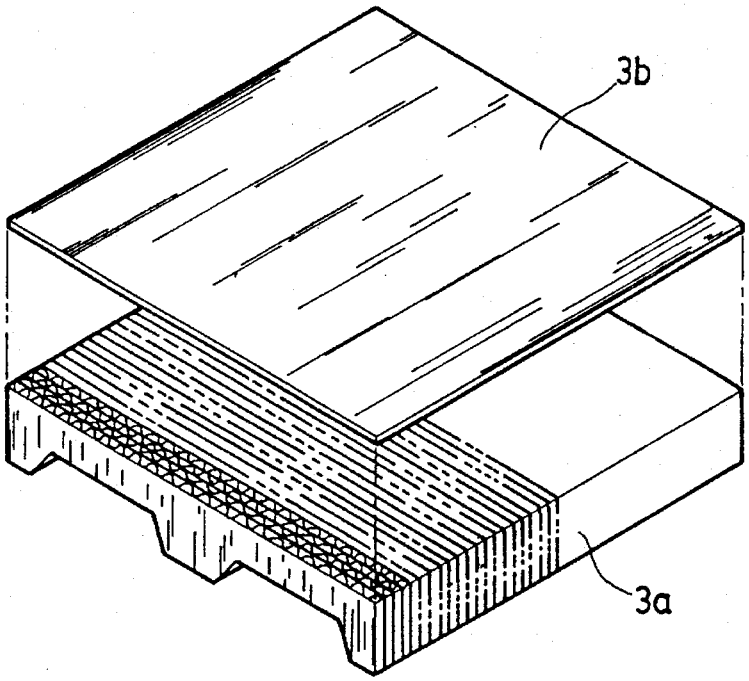
FIG.8
FIG.9
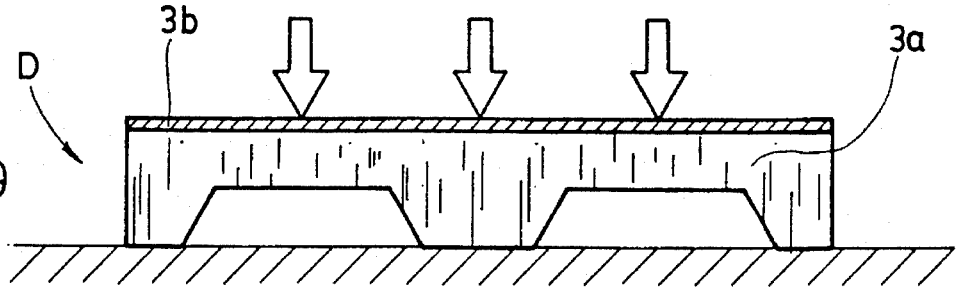
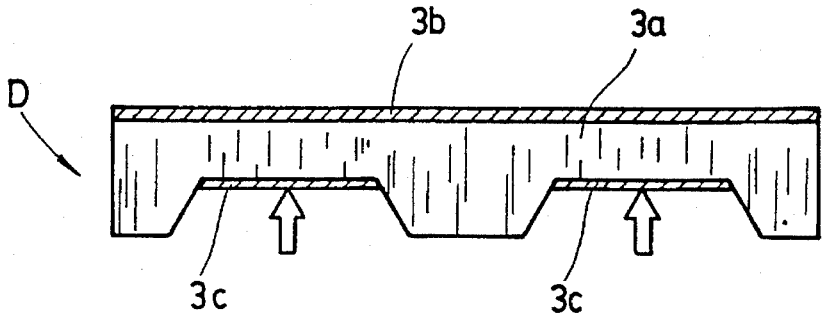
FIG.10

PAPER PALLET WITH AN IMMPROVED CONFIGURATION

RELATED PATENT APPLICATION

This patent application is a Continuation-in-Part of patent application Ser. No. 08/246,188, filed on 19 May 1994, now abandoned.

BACKGROUND OF THE INVENTION

This invention is directed to a system for forming a paper pallet. More specifically, it is directed to a system for forming a cardboard pallet having an improved configuration. This cardboard pallet is formed from cardboard panels which may or may not have been suitably treated or processed for increased rigidity.

Cardboard pallets are a necessity in the storage and transport of many industrial products. A single-decked pallet of the prior art generally includes at least three stringers which are parallel and spaced apart by a preset distance, a forklift member entry being provided between adjacent stringers. Such a pallet has a deckboard formed by a plurality of elongate wooden panels attached transversely across the top of the stringers. As lumber becomes increasingly scarce, there will be an increasing need for such wooden pallets to be replaced by pallets formed from other materials such as condensed cardboard panels. Cardboard panels, however, possess significantly less strength than wood panels. Consequently, prior art pallets formed from condensed cardboard panels generally suffer from several notable shortcomings.

Referring to FIGS. 1, 2, and 3, a prior art cardboard pallet 1 includes a deckboard 11 which is formed from a plurality of layered cardboard panels. Such a multi-layered deckboard 11 is supported by a number of cardboard stringers 12 attached to its underside. Manufacture of this prior art pallet 11 requires much time and skilled effort, as it invariably requires complex assembly steps practically suited only for manual assembly. For instance, a cardboard panel must be folded to form a stringer 12 before it is individually attached to the underside of the deckboard 11 by adhesive. Thus, the daily manufacturing yield of stringers 12, and consequently the manufacturing yield of pallets 1, is extremely low.

Another shortcoming of prior art pallets 1 resides in the fact that deckboard 11, being formed from layered cardboard panels, is characterized by relatively poor strength, bending quite easily when anything more than a nominal load is applied. This lack of strength results because the corrugations which provide reinforcement against forces applied parallel to the plane of each cardboard panel are not optimally oriented. The load applied on a pallet 1 generates primarily a downward force which is perpendicular to the direction along which the corrugations extend. The corrugations, therefore, are essentially of no consequence in reinforcing deckboard 11 against deformation due to such force, and where it has formed on its surface a fold line, the supporting strength of deckboard 11 is diminished even more. Stress concentration occurs along such a fold line, with pallet 1 eventually experiencing structural failure along that fold line if the load is not soon removed.

Some manufacturers add hardware maintenance or increase the layers of stringers 12 and deckboard 11 to enhance the strength of cardboard pallet 1, but the strength added thereby is limited. Moreover, when pallet 1 is lifted by a forklift, the entire load of that pallet 1 will fall directly on deckboard 11, causing it to bend. No amount of hardening agent and no practical number of additional layers will enable deckboard 11 to overcome the lack of strength inherent in its structural configuration. Hence, such a prior art cardboard pallet 1 is insufficient to replace wooden panels.

SUMMARY OF THE INVENTION

It is an object of the present invention to provide a system for forming a cardboard pallet with an improved configuration to withstand more stress applied by loads than prior art cardboard pallets are able to withstand.

It is another object of the present invention to provide a cardboard pallet with an improved configuration wherein the corrugations of the cardboard panels employed are optimally oriented such that they provide substantial reinforcement against loads.

It is yet another object of the present invention to provide a cardboard pallet wherein the deckboard and its stringers are integrally formed to optimize the supporting strength realized thereby.

BRIEF DESCRIPTION OF THE DRAWINGS

The objects and other advantages of the present invention will become more apparent to those skilled in the art from the following detailed description of a preferred embodiment, especially when considered in conjunction with the accompanying Drawings, wherein:

FIG. 8 is an exploded perspective view of the preferred embodiment of a cardboard pallet made at according to the present invention;

FIG. 9 is an elevational view of the cardboard pallet shown in FIG. 7 illustrating the downward stress applied thereto by a load;

FIG. 10 is an elevational view of a second embodiment of a cardboard pallet made according to the present invention;

DETAILED DESCRIPTION OF THE PREFERRED EMBODIMENTS

Figure 1:
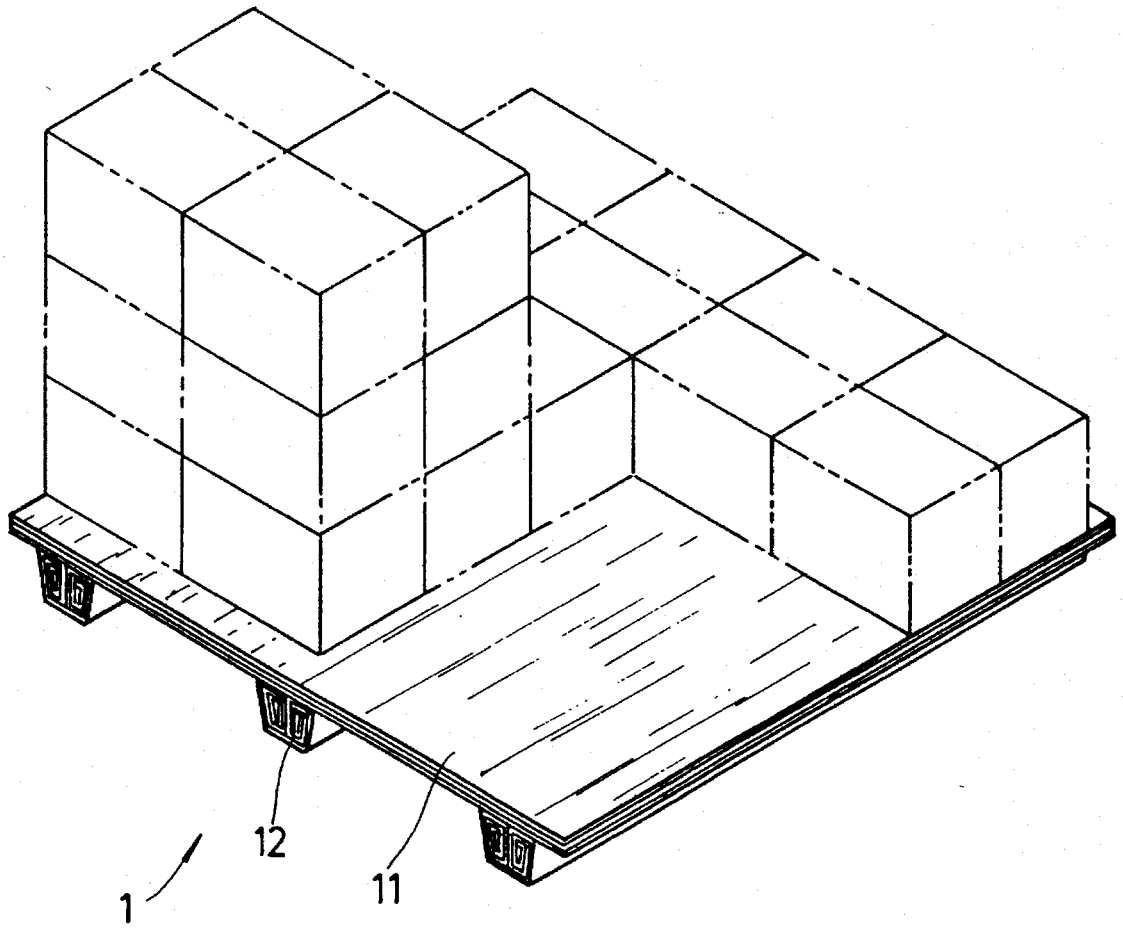
PRIOR ART FIG.1
FIG. 1 is a perspective view showing a prior art cardboard pallet.
Figure 2:
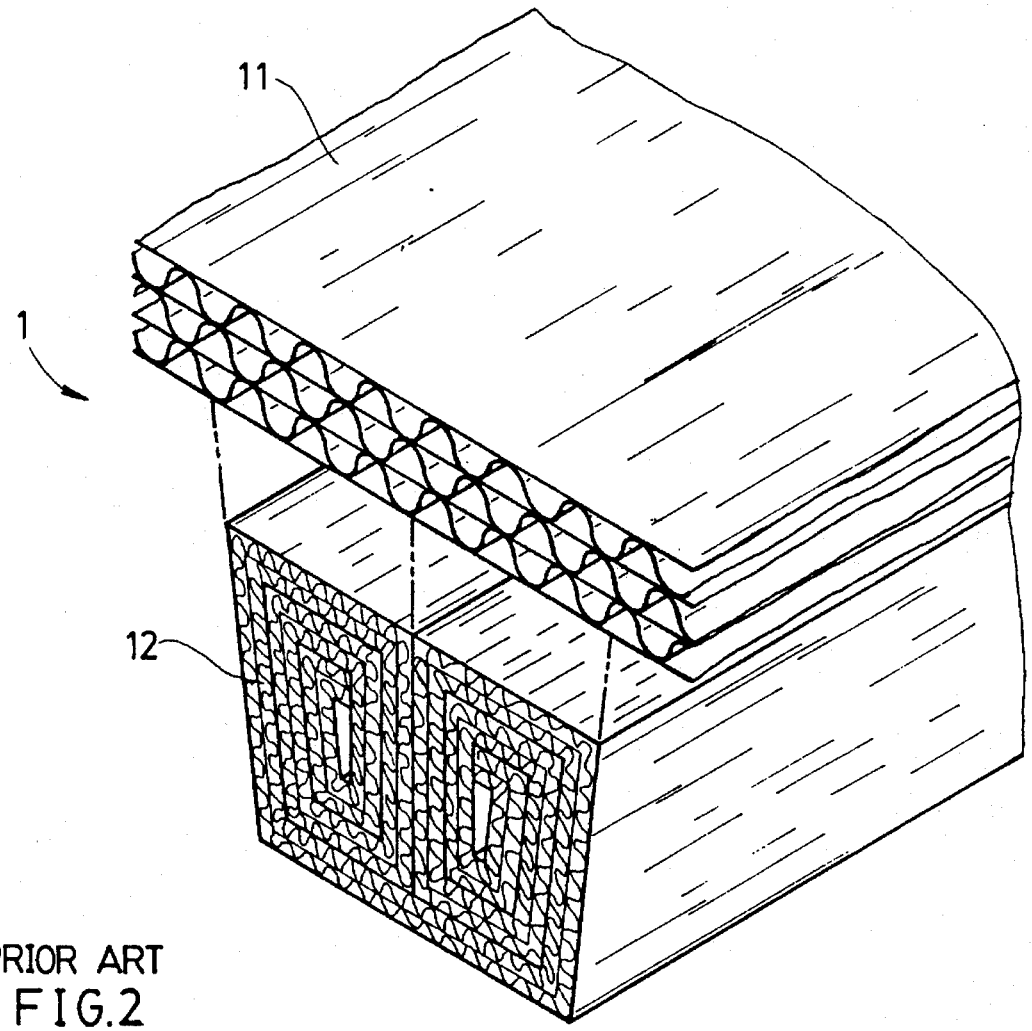
PRIOR ART FIG.2
FIG. 2 is an exploded perspective view, partially cut-away, of a portion of the prior art cardboard pallet of FIG. 1.
Figure 3:
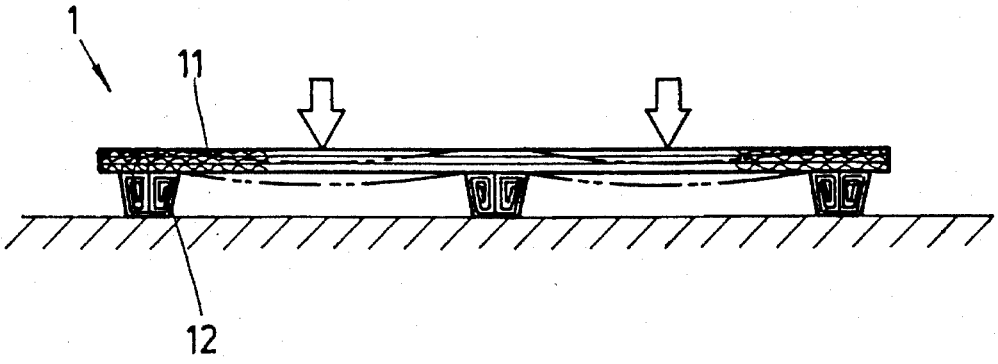
PRIOR ART FIG.3
FIG. 3 is an elevational view of the prior art cardboard pallet of FIG. 1 illustrating the effect of a downward force applied thereto.
Figure 4:
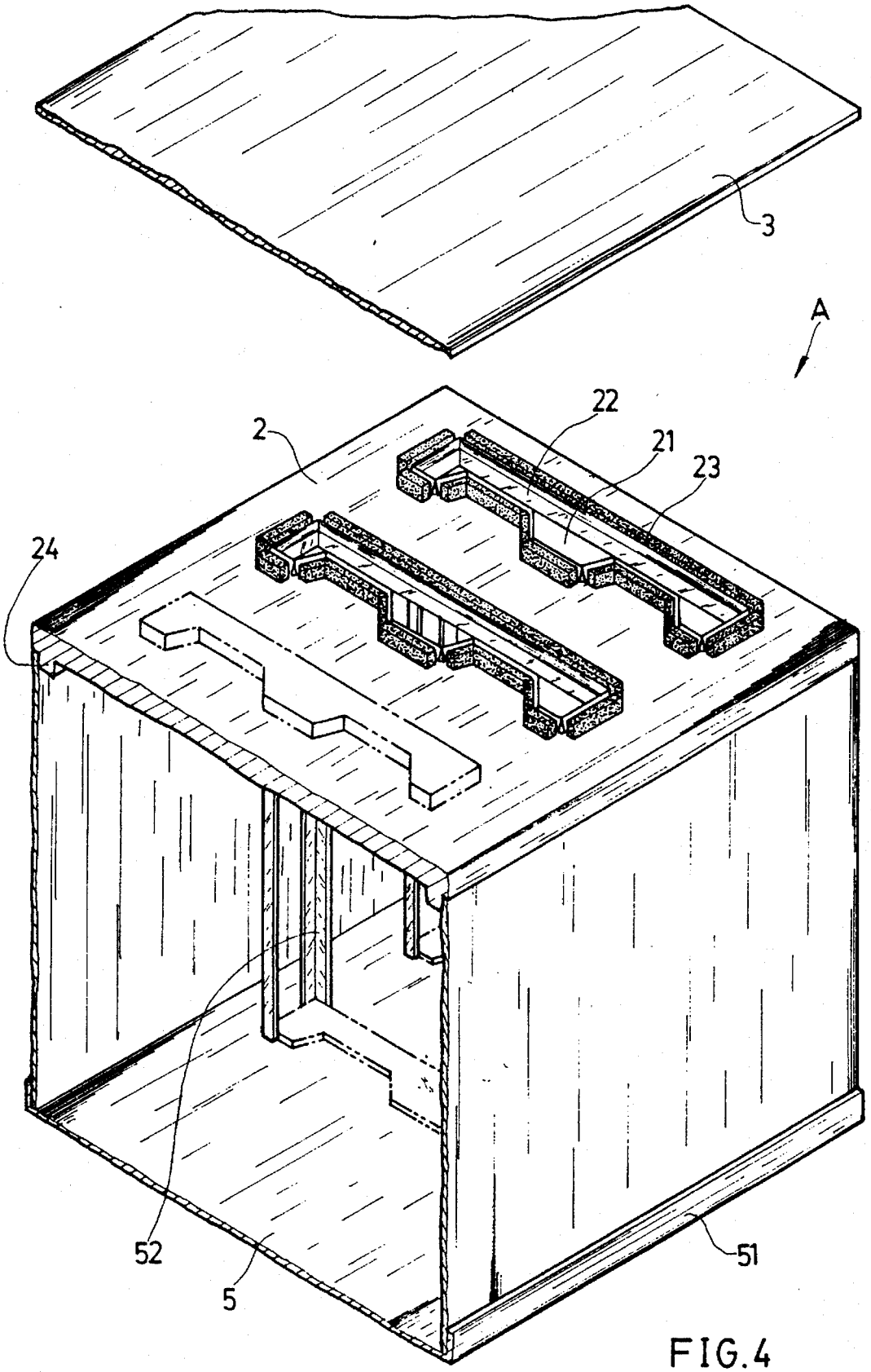
FIG. 4 is a perspective view partially cut-away, of the preferred embodiment of the cutting device of the present invention illustrating the placement thereon of a cardboard panel to be cut.
Figure 5:
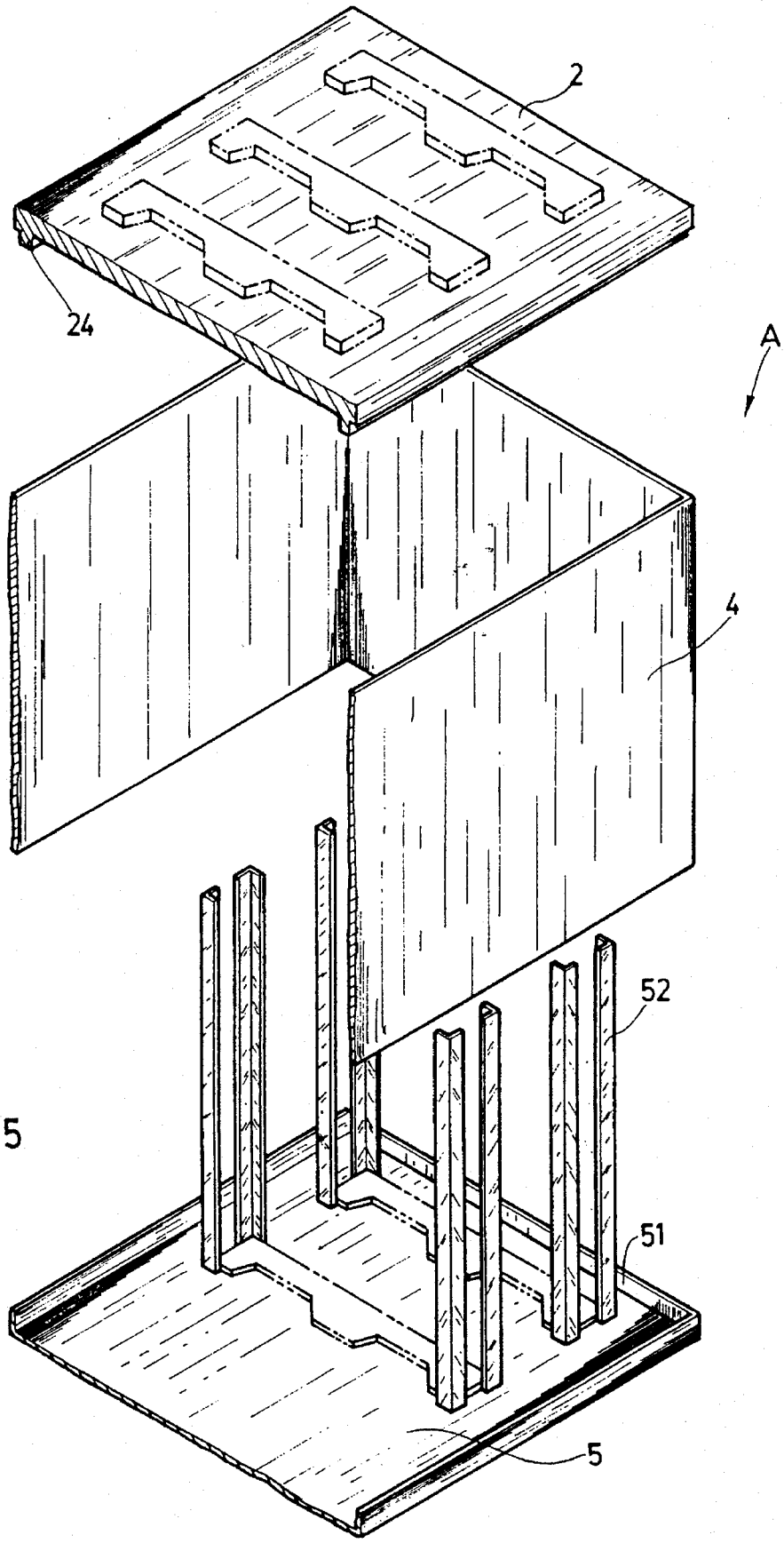
FIG. 5 is an exploded perspective view, partially cut-away, of the preferred embodiment of the cutting device of the present invention.

Referring now to FIGS. 4 and 5, there is shown a cutting device A made according to the present invention. Cutting device A generally comprises a cutting board 2 for cutting a cardboard panel 3. A plurality of through openings 21 having a predetermined peripheral contour are provided through the planar surface of cutting board 2. A cutter 22 is provided around the periphery of each through opening 21. Adjacent the outer sides of the cutters 22 are provided resilient stop portions 23 preferably formed of a rubber composition and affixed to the cutting board 2. A downward projecting rim portion 24 is provided at the edges of the cutting board 2.

The cutting board 2 is coupled to a box-like support frame 4 having a predetermined height. The support frame 4 is open at its top and bottom portions, the edges that form its top portion being adapted to engage the rim portion 24 of cutting board 2.

Coupled to the bottom portion of support frame 4 is a base board 5 having a flange portion 51 projecting upward along its periphery. The bottom of the support frame portion 4 is adapted to be received within the flange portion 51.

A plurality of guide posts 52 extend substantially normally from base board 5, each aligning with a peripheral portion of a through opening 21 of the cutting board 2.

Figure 6:
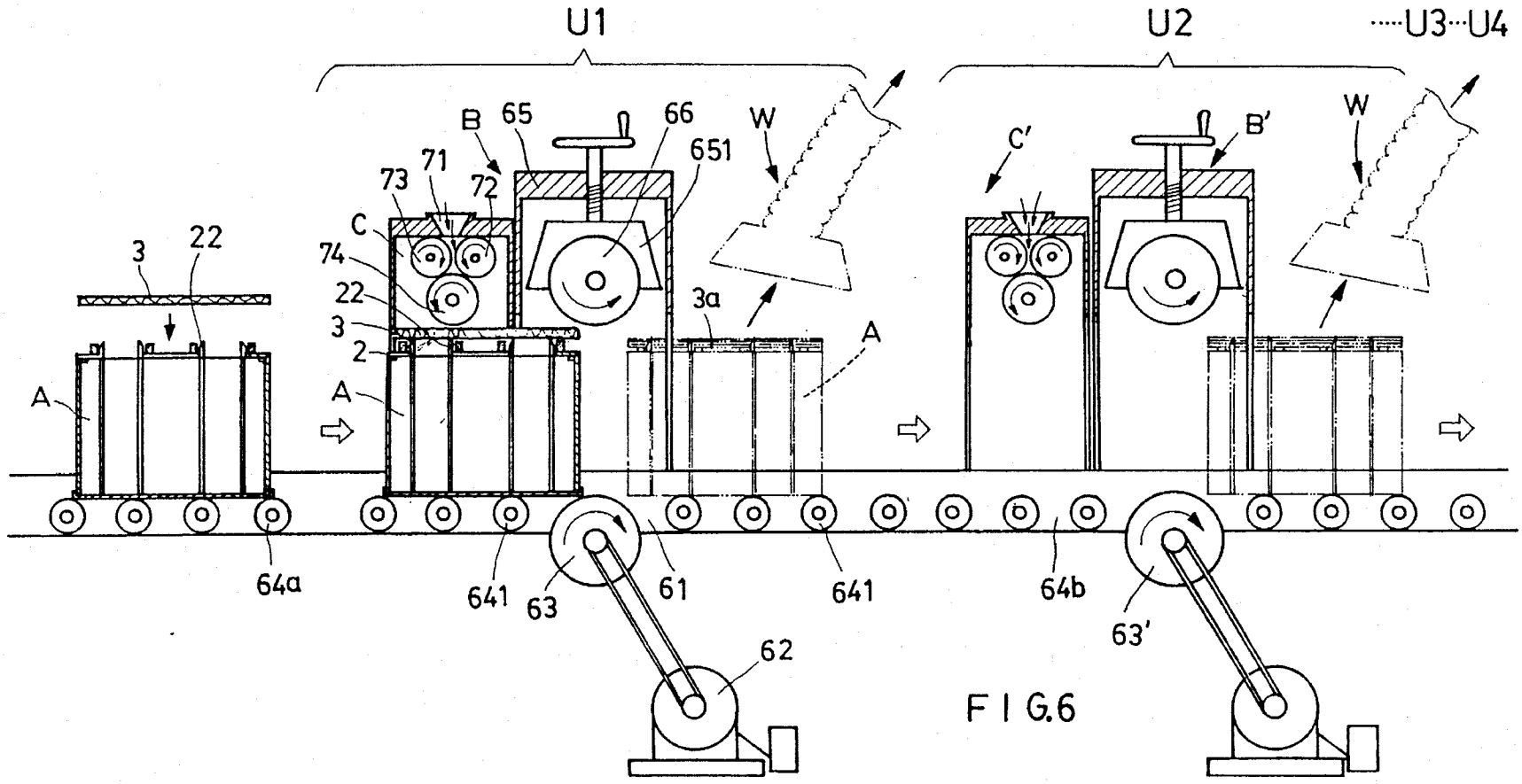
FIG. 6 is a schematic diagram of the preferred embodiment of a pallet forming system of the present invention illustrating the interaction of the extrusion mechanism and cutting device.
Figure 7A:
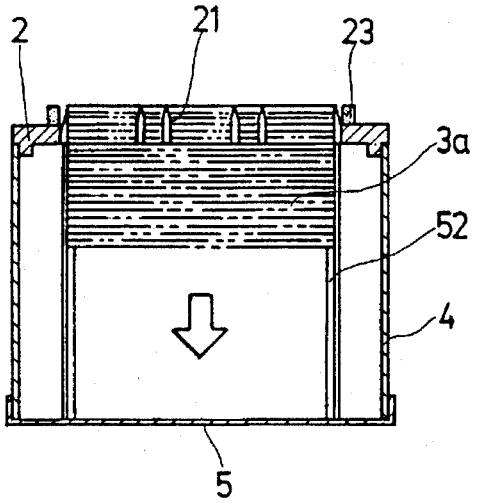
FIG. 7(*a*)–7(*d*) is a schematic diagram illustrating the sequential formation of a portion of a cardboard pallet formed according to the present invention.
Figure 7C:
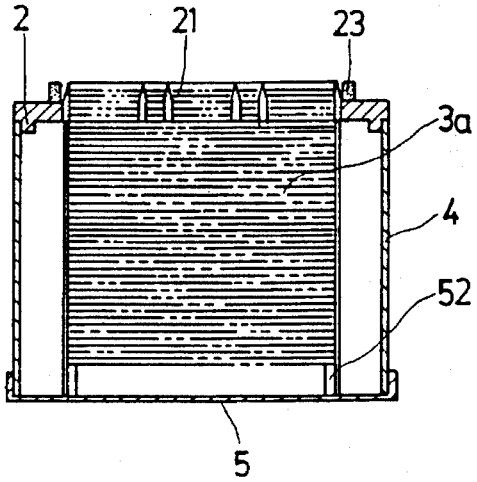
Figure 7B:
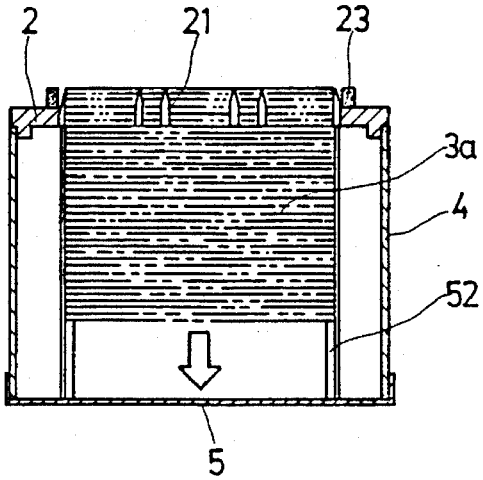
Figure 7D:
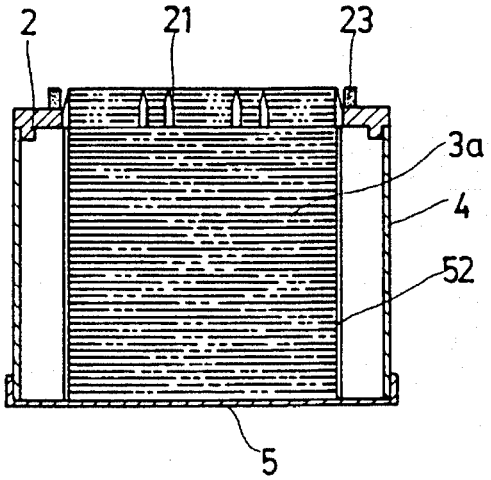

Referring to FIG. 6, there is shown a plurality of pallet forming systems U1–U4 of the present invention. In the operation of each system U1–U4, a cardboard panel 3 to be cut is first placed on a cutting device A. Cutting device A is then advanced to an adhesive application mechanism C which applies a layer of adhesive on the exposed planar surface of cardboard panel 3. Cutting device A is thereafter advanced to an extruding mechanism B which presses the cardboard panel 3 onto the cutting board 2 to thereby extrude and accumulate a plurality of cardboard extrusion members 3*a* (FIG. 7). Thus, when cutting device A passes through extruding mechanism B of one pallet forming system U1, one layer of cardboard panel extrusion members 3*a* is cut and collected therewithin. As cutting device A is advanced past extruding mechanism B, a blower mechanism W blows away cardboard debris. Cutting device A is then advanced to another pallet forming system U2 for a repetition of the preceding steps. This may be carried out by providing as many sequentially arranged pallet forming systems U2–U4 as necessary to form the desired number of layers of extrusion members 3*a*; or, in the alternative, by providing a looped conveying path to return cutting device A to the same forming system U1 after each iterative cycle of adhesive application, cardboard panel extrusion, and debris clearing.

Extruding mechanism B generally comprises a base platform, or table, 61 having a delivering roller 63 driven by a motor 62 connected thereto. Front and rear conveying mechanisms 64*a* and 64*b* are respectively provided at the front and rear portions of table 61. Conveying mechanisms 64*a*, 64*b* may be of any length suitable for the desired application, and are preferably formed by a plurality of rollers 641.

A housing 65 is disposed above table 61, and a pressing roller 66 is provided a fixed distance above the delivering roller 63. An adjusting post 651 coupled to pressing roller 66 is provided to enable user-adjustment of the height of pressing roller 66 above delivering roller 63.

By this arrangement, cutting device A is advanced into the housing 65 on the rollers 641 of the front conveying mechanism 64*a*. When cutting device A reaches a predetermined position, the motor 62 is actuated and the roller 63 is responsively rotated. This urges the cutting device A forward. Meanwhile, the pressing roller 66 is contacted by cutting board 2 of device A and the cardboard panel 3 carried thereon. This causes pressing roller 66 to rotate counterclockwise, and the cardboard panel 3 is pressed downward to be cut by the cutter 22.

An adhesive application mechanism C is provided in front of extruding mechanism B, such that adhesive is applied on cardboard panel 3 before it is cut. As a result, when the cardboard panel 3 is cut to form an extrusion member 3*a* having a predetermined shape captured within the cutter 22 to fill a through opening 21, the extrusion member 3*a* has a layer of adhesive already applied thereon. When the next cut extrusion member 3*a* is formed, it is adhesively pressed onto the previously formed extrusion member 3*a*.

Adhesive application mechanism C has a feed port 71 to receive an adhesive composition which is then applied on the cardboard panel 3 by a group of rollers 72, 73, and 74. Adhesive application mechanism C is a conventional mechanism, and no further description therefor is given.

Referring to FIGS. 7(A)–7(D), when a plurality of cardboard panels 3 are cut iteratively, a plurality of cut cardboard extrusion members 3*a* are accumulated in layers on base board 5, the layers being retained in alignment within guide posts 52. When a predetermined thickness of the accumulated layers is reached, the resulting cardboard assembly is removed from cutting device A for the formation of another such assembly.

Referring to FIG. 8, when the assembly of layered extrusion members 3*a* is removed from cutting device A, a reinforcing cardboard panel 3*b* is attached to an upper surface collectively formed by aligned edges of extrusion members 3*a*. Reinforcing cardboard panel 3*b* not only reinforces the assembly of extrusion members 3*a* from deformation, it prevents extrusion members 3*a* from separating when a shearing force results from an applied load. Greater durability of the resulting pallet D is thus achieved.

Referring to FIG. 10, pallet D may be provided with a second layer of cardboard panels 3*c* at the bottom thereof to further reinforce against deformation and separation of extrusion members 3*a* when pallet D is lifted by the forks of a forklift.

Figure 11:
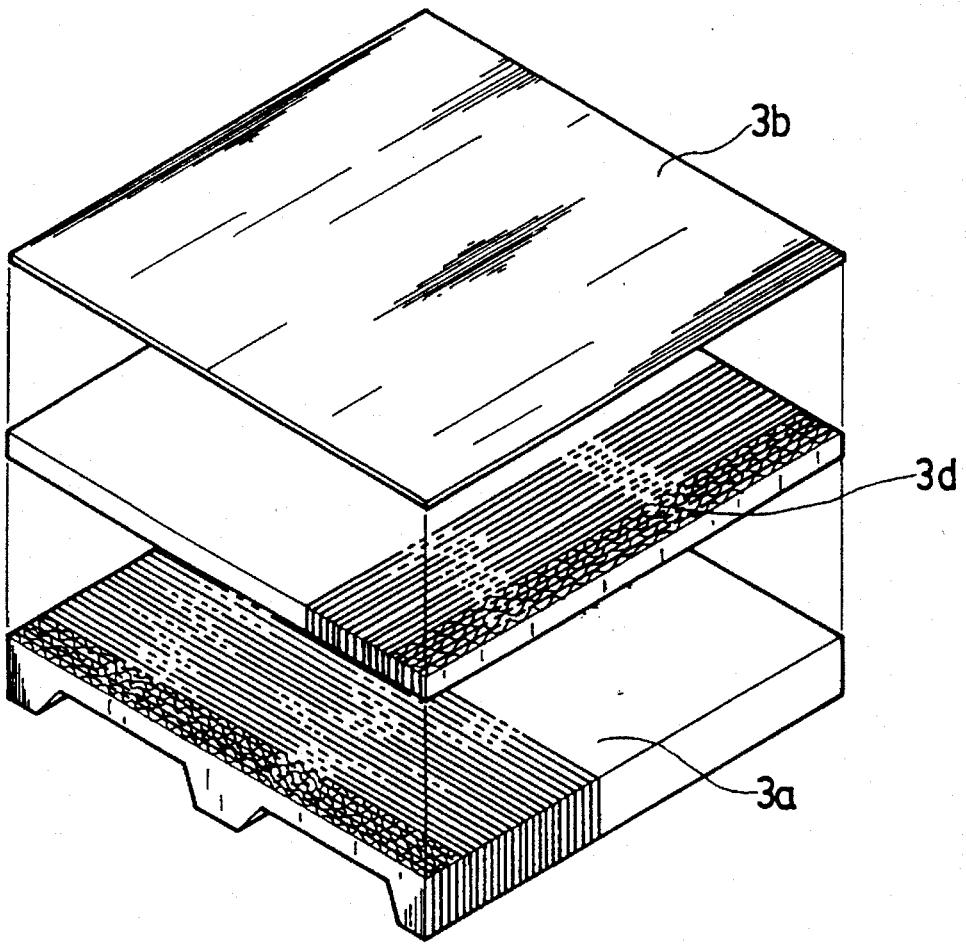
FIG. 11 is an exploded perspective view of a third embodiment of a cardboard pallet made according to the present invention; and, FIG. 12 is a cross-sectional view of the cardboard pallet shown in FIG. 11.
Figure 12:
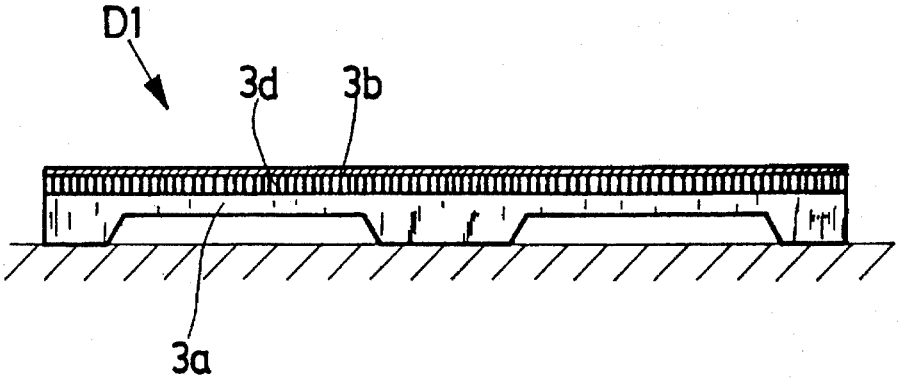

Referring to FIGS. 11 and 12, in order to further enhance the strength of pallet D so it may sustain greater loads, cutting device A may be used to cut more than one assembly of cardboard extrusion members 3*a*. By configuring a cutting device A to have through openings 21 of a variant peripheral contour and arranging cutter 22 accordingly on cutting board 2, a reinforcing assembly of extrusion members 3*d* may be formed by employing the steps already described. As shown in FIG. 11, this reinforcing assembly of extrusion members 3*d* may be attached to the upper surface of the assembly of extrusion members 3*a* in such a manner that the extrusion members 3*d* extend in a transverse direction relative to extension members 3*a*. By this arrangement, a stronger pallet D1 may be formed to sustain greater loads. More extrusion member assemblies may be added in this manner to further reinforce pallet D1. A reinforcing cardboard panel 3*b* may then be attached to an upper surface formed by the upper-most extrusion member assembly to enhance the strength of the pallet D1.

This invention, therefore, offers the following advantages. A pallet D, D1 made according to this invention is formed essentially by integration of a plurality of integrally-formed individual pallet units characterized by a common predetermined shape. The resulting configuration maintains the orientation of the cardboard panels employed such that substantially all their corrugations extend vertically, parallel to the loads applied to the pallet D, D1. Consequently, pallet D, D1 is able to sustain more load than prior art cardboard pallets. The main body portions of pallet D, D1 are sandwiched between reinforcing cardboard panels 3b, 3c. As a result, a stronger configuration is realized which is resistant to separation of its integrated individual pallet units.

A pallet D, D1 made according to, this invention may be efficiently manufactured, without substantial human intervention. Accordingly, the daily manufacturing yield of the pallet D, D1 may be several times that of a prior art cardboard pallet.

As the loads applied to a pallet D, D1 is parallel to substantially all the corrugations of the cardboard panel employed, pallet D, D1 is substantially immune to the detrimental effects on structural integrity of folds or cracks that may be present along its top surface.

Each of the individual cardboard extrusion members 3a, 3d of a given pallet D, D1 is cut by the same cutting device A, so the extrusion members 3a, 3d have virtually uniform peripheral contour. Furthermore, they are firmly bonded together by an adhesive thoroughly applied prior to their cutting.

Although the present invention has been described in connection with the preferred embodiments, it will be apparent to those skilled in the art that many other variations and modifications may be made without departing from the spirit or scope of the invention. It is intended, therefore, that the present invention not be limited by the specific disclosure herein, but only by the appended Claims.

I claim:

1. A pallet forming system for forming a pallet from a plurality of cardboard panels comprising:

(a) a cutting device for the extruding portions of respective cardboard panels of said plurality of cardboard panels therethrough to form a plurality of extrusion members having a predetermined peripheral contour, said cutting device sequentially accumulating said extrusion members in a peripherally aligned manner;

(b) an extruding mechanism operably coupled to said cutting device for pressing said respective cardboard panels into engagement with said cutting device for extruding said extrusion members thereby; and, (c) adhesive application means coupled to said extruding mechanism for applying before extruding thereof an adhesive composition to said respective cardboard panels.

2. The pallet forming system as recited in claim 1 wherein said cutting device includes;

(a) a cutting board having a substantially planar portion defined by opposing first and second surfaces, said planar portion having at least one through opening formed therein, at least one blade portion and a resilient stop portion projecting from said first surface thereof, said through opening being defined by said predetermined peripheral contour;

(b) a base board assembly for retaining said extrusion members, said base board assembly having a substantially planar retaining surface and at least a pair of guide posts extending therefrom, said guide posts cooperatively guiding said extrusion members into said peripherally aligned accumulation thereof; and, (c) a support frame coupled to said second surface of said cutting board and couple to said base board for maintaining said cutting board in spaced relation to said base board, said support frame being adapted to maintain a predetermined separation therebetween.

3. The pallet forming system as recited in claim 2 wherein said extruding mechanism includes;

(a) a base platform having conveying means for displaceably supporting said cutting device thereon;

(b) a delivering roller coupled to said base platform for engaging said cutting device to impart thereto a displacement force, whereby said cutting device is displaced along said conveying means of said base platform;

(c) a pressing roller coupled to said base platform and disposed in spaced relation to said delivering roller for engaging respective ones of said cardboard panels to impart thereto a depressing force, whereby said respective cardboard panels are pressed against said cutting board of said cutting device.

4. The pallet forming system as recited in claim 3 wherein said pressing roller has coupled thereto height adjusting means for selectively displacing said pressing roller relative to said delivering roller.

5. The pallet forming system as recited in claim 2 wherein said cutting board includes a rim portion extending substantially perpendicularly from said second surface thereof, and said base board includes a flange portion extending from said retaining surface thereof, said rim and flange portions being engaged by said support frame.

6. The pallet forming system as recited in claim 1 wherein said adhesive application means applies said adhesive composition to at least one of said respective cardboard panels prior to said extrusion of said extrusion members.

7. The pallet forming system as recited in claim 6 wherein said pallet formed thereby includes;

(a) a pallet body formed by a plurality of said extrusion members glued together by said adhesive composition, said pallet body having top and bottom faces and having a sectional contour defined by said predetermined peripheral contour of each said extrusion member;

(b) at least one top reinforcement cardboard panel attached to said top face of said pallet body; and (c) at least one bottom reinforcement cardboard panel attached to said bottom face of said pallet body.

8. The pallet forming system as recited in claim 7 wherein said pallet formed thereby includes;

(a) a first pallet body formed by a plurality of said extrusion members having a first peripheral contour glued together by said adhesive composition, said first pallet body having top and bottom faces and having a sectional contour defined by said first peripheral contour;

(b) a second pallet body coupled to said first pallet body, said second pallet body being formed by a plurality of said extrusion members having a second peripheral contour glued together by said adhesive composition, said second pallet body having top and bottom faces and having a sectional contour defined by said second peripheral contour, said top face of said second pallet body underlying said bottom face of said first pallet body; and (b) at least one reinforcement cardboard panel attached to said top face of said first pallet body.

* * * * *